US006875095B2

(12) United States Patent
Walker

(10) Patent No.: US 6,875,095 B2
(45) Date of Patent: Apr. 5, 2005

(54) OSCILLATING HAND TOOL

(75) Inventor: Andrew Walker, Newton Hall (GB)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 10/193,821

(22) Filed: Jul. 12, 2002

(65) Prior Publication Data

US 2003/0017796 A1 Jan. 23, 2003

(30) Foreign Application Priority Data

Jul. 20, 2001 (GB) ..... 0117668

(51) Int. Cl.[7] ..... B24B 23/04
(52) U.S. Cl. ..... 451/357; 451/159
(58) Field of Search ..... 451/357, 359, 451/270, 271, 159

(56) References Cited

U.S. PATENT DOCUMENTS 2,639,564 A * 5/1953 Atkin ..... 451/357
3,862,520 A * 1/1975 Klebe, Jr. et al. ..... 451/357
4,095,375 A * 6/1978 Klebe et al. ..... 451/357
4,744,177 A * 5/1988 Braun et al. ..... 451/357
6,062,960 A 5/2000 Kai et al. ..... 451/357
6,132,300 A * 10/2000 Martin ..... 451/357
6,159,084 A * 12/2000 Tiede ..... 451/357

FOREIGN PATENT DOCUMENTS

EP 0 953 407 B1 6/2002
FR 1091481 4/1955
JP 60-35171 * 7/1985 ..... 451/357

* cited by examiner

*Primary Examiner*—Robert A. Rose
(74) *Attorney, Agent, or Firm*—Bruce S. Shapiro; John D. DelPonti; John Yun

(57) ABSTRACT

The powered oscillated hand tool is provided having a housing and a drive unit contained in the housing having a first drive shaft 7 and a bearing 15 mounted eccentrically relative to the first drive shaft 7. A second drive shaft 14 extends from the bearing 15 and mountable thereon is a mounting platen 90 which is secured by means of one or more flexible legs 80 to the housing. The mounting platen 90 has coupling means 95 which are securable with corresponding coupling means on a first sanding platen 20 which is secured against free rotation about the second drive shaft when mounted thereon.

18 Claims, 4 Drawing Sheets

OSCILLATING HAND TOOL

The present invention relates to a powered oscillating hand tool, and especially to a powered oscillating hand tool with an eccentrically mounted drive shaft and a sander attachment that can be secured against free rotation about the drive shaft.

Oscillating hand tools with sander attachments are well known. In general, known sanders can be described as either orbital sanders or random orbit sanders, or may combine both facilities in a single hand tool.

Orbital sanders typically comprise a shaped sanding shoe, the drive system of which exhibits an eccentric motion which is restrained so that the sanding shoe can not spin independently of the motor. Therefore in such orbital sanders there is no free rotation of the sanding shoe about its axis. Such orbital sander shoes are generally used for removal of relatively small quantities of material, for example for detailed work or for finishing. Also the shoe may be shaped for access to awkward corners or the like, and may be used for any removal of material in these places.

In contrast, random orbit sander typically comprise a circular platen driven by a drive system which comprises an eccentric bearing so that the platen can spin independently of the motor, and the platen describes a random orbit. Therefore in random orbit sanders, the sanding platen is permitted free rotation about its axis. Such sanders are in general used for the removal of relatively large quantities of material.

EP-A-0694365 describes a single hand tool that is adapted to receive interchangeable sander platens, and perform a dual function: as an orbital sander with a sanding platen secured against free rotation, and as a random orbit sander, with a freely rotating sanding platen. This reference describes a bearing mounted eccentrically on a first drive shaft, and a second drive shaft mounted on the eccentric bearing on which an orbital sander platen and a random orbit sander platen can be interchangeably mounted. A plurality of flexible columns are fitted to the orbital sander platen and these co-operate with rigid components on the housing so that the orbital platen is prevented from free rotation. Alternatively the position of the flexible columns and rigid components can be interchanged. The interchangeable random orbit sanding platen does not have any similar means to couple with the housing and hence is permitted free rotation.

We have designed an alternative means of mounting a sanding platen so as to prevent free rotation of the platen, using an intermediate mounting platen that is fixed to the housing. The hand tool is a modification of the hand tool described in EP-A-0694365, the entire disclosure of which is incorporated herein by reference.

Accordingly a first aspect of the present invention provides a powered oscillating hand tool comprising a housing; a drive unit contained in the housing and having a first drive shaft; a bearing mounted on the said first drive shaft which is located radially eccentrically relative to the first drive shaft, and which drives a second drive shaft; a mounting platen secured to the housing by means of one or more flexible legs extending from a surface of the mounting platen, and comprising coupling means comprising one or more shaped parts on a surface of the mounting platen; and a first sanding platen, which is securable against free rotation about the second drive shaft, the first sanding platen comprising coupling means arranged to couple with the coupling means on the mounting platen to provide the said securement against free rotation of the first sanding platen about the second drive shaft.

By "a shaped part" we mean a part shaped distinctly from the surface on which it is located.

Two or more separate coupling means may be provided by the mounting platen. Both coupling means may be separate parts on the surface of the mounting platen, e.g shaped parts on the surface of the mounting platen, or one of the coupling means may comprise the peripheral shape of the mounting platen itself. This may co-operate with the peripheral shape of the first sanding platen. For example, the first sanding platen may be provided with a lipped edge which fits around the periphery of the mounting platen. The peripheries may be shaped, e.g. non-circular, to enhance the co-operation and prevent relative slipping.

The provision of a hand tool as described above with a mounting platen providing two or more separate coupling means of any form, not necessarily shaped parts, is novel per se.

Therefore a second aspect of the present invention provides a powered oscillating hand tool comprising a housing; a drive unit contained in the housing and having a first drive shaft; a bearing mounted on the said first drive shaft which is located radially eccentrically relative to the first drive shaft, and which drives a second drive shaft; a mounting platen secured to the housing by means of one or more flexible legs extending from a surface of the mounting platen, and comprising two or more separate coupling means; and a first sanding platen, which is securable against free rotation about the second drive shaft, the first sanding platen comprising coupling means arranged to couple with the coupling means on the mounting platen to provide the said securement against free rotation of the first sanding platen about the second drive shaft.

In the hand tool according to the second aspect of the invention at least one of the coupling means of the mounting platen is preferably a shaped part as defined above. One of the coupling means may also be the periphery of the mounting platen, as similarly described above.

All following preferred features apply to the hand tool according to both the first and second aspect of the invention.

Where shaped part coupling means are provided on a surface of the mounting platen these preferably project from, or are recessed into, the said surface of the mounting platen.

The first sanding platen is usually mountable on the second drive, and the mounting platen preferably surrounds, but does not contact the second drive shaft. The mounting platen may comprise a large central aperture which is arranged to be located around the second drive shaft. The mounting platen is therefore preferably spaced laterally from the drive shaft.

Preferably, as in EP-A-0694365, the first sanding platen of the hand tool of the first and second aspect of the invention is interchangeable with a second sanding platen. In this case the hand tool according to the first or second aspect of the invention preferably comprises a second sanding platen, which is mountable on the second drive shaft so as to be free to rotate about the second drive shaft. The second sanding platen is preferably mountable on the second drive shaft in such a way that neither the mounting platen nor any coupling means on the mounting platen engages the second sanding platen, which is therefore allowed to rotate freely.

Where an additional second platen is included, a brake means is preferably provided on the mounting platen. This is preferably situated on the mounting platen so as to apply a compressive force onto an opposing surface of the second sanding platen to slow its rotation in use for safety reasons, and also to stop the rotation more rapidly when the motor is switched off. The braking means preferably comprises a low friction material so that the free rotation of the second sanding platen is not prevented: it is merely slowed to safe limits. Preferably the brake slows the revolutionary speed of the second platen to less than 20%, preferably to about 10% of its non-braked speed.

Where the coupling means is provided on a surface of the mounting platen, it may be on any surface of the mounting platen. Preferably the coupling means of the mounting platen is on a different surface of the mounting platen from the flexible leg(s) that extend from the mounting platen to fix it to the housing. Most preferably the coupling means on the mounting platen are on the opposite surface of the mounting platen from the flexible leg(s).

Preferably two or more separate coupling means are provided on a common surface of the mounting platen, and these are preferably spaced across the said surface of the mounting platen. Preferably a corresponding number of coupling means are provided on the first sanding platen, preferably correspondingly located spaced apart across the said surface of their respective platens. The coupling means may be uniformly or non uniformly spaced apart across the surface of the mounting platen. An advantage of non uniform spacing is that it means the first sanding platen can only engage the coupling means on the mounting platen in one orientation; i.e. there is no risk of the user installing the sanding platen back to front (if it is a non-uniformly shaped platen designed to be positioned in one orientation only).

The coupling means on the mounting platen, or the coupling means on the first sanding platen, or both, may project from their respective surfaces, and/or may comprise a hollow recess. Where one of the coupling means on one of the platens comprises a hollow recess, at least one of the coupling means on the other of the first sanding platen or the mounting platen comprises a central member, preferably a pin-shaped central member, shaped and sized to fit into the said hollow recess.

Where the coupling member comprises a hollow recess, this may be a depression in the surface of the platen, or may be contained within a projection from the said platen.

Where the coupling member comprises a projection, it is preferably a right cylindrical projection, or any other projection of regular, but non-circular, cross-section.

The coupling means of the mounting platen and first sanding platen are arranged substantially to prevent free rotation of the first sanding platen about the second drive shaft. To this end they preferably engage so that the platens are located in substantially parallel planes, and the coupling means substantially prevent relative movement of the platens in any direction parallel to the planes of the platens. The coupling means preferably allow relative movement of the mounting platen and the first sanding platen in other directions, e.g. in the direction perpendicular to the planes of the platens; this movement allowing the first sanding platen to be brought onto, or withdrawn from the mounting platen.

The mounting platen is secured to the housing by means of one or more flexible legs. In operation, since the mounting platen is secured to the housing, and also coupled to the first sanding platen, when the motor is turned on the first sanding platen attempts to rotate about the bearing axis, but this free rotation is substantially prevented by the coupling means. The flexibility of the mounting platen leg(s), however, allow the first sanding platen to follow the eccentric motion of the second drive shaft, and the first sanding platen therefore oscillates within a fixed regular orbit.

For stability two or more flexible legs are preferably provided on the mounting platen, especially three, four, or more legs spaced across the surface of the mounting platen. The one or more flexible legs preferably comprise natural or synthetic rubber, or a similar flexible polymeric moulded material.

Kits of parts comprising the mounting platen as described above in combination with the first sanding platen in the absence of the other parts of the hand tool are also novel per se.

Therefore a third aspect of the present invention provides a kit of parts for use in a powered oscillating hand tool comprising a housing containing an eccentrically driven drive shaft capable of accepting a first sanding platen that is securable against free rotation about the eccentrically driven drive shaft; the kit of parts comprising a mounting platen, which in use can be secured to the housing of the tool, and which comprises coupling means in the form of one or more shaped parts on a surface of the mounting platen for co-operating with the first sanding platen when mounted in use; and the first sanding platen comprising coupling means for co-operating with the coupling means on the mounting platen to provide the said securement against free rotation of the first sanding platen when mounted on the drive shaft in use.

Similarly a fourth aspect of the present invention provides a kit of parts for use in a powered oscillating hand tool comprising a housing containing an eccentrically driven drive shaft capable of accepting a first sanding platen that is securable against free rotation about the eccentrically driven drive shaft; the kit of parts comprising a mounting platen, which in use can be secured to the housing of the tool, and which comprises two or more separate coupling means for co-operating with the first sanding platen when mounted in use; and the first sanding platen, comprising coupling means for co-operating with the coupling means on the mounting platen to provide the said securement against free rotation of the first sanding platen when mounted on the drive shaft in use.

Preferred features for the mounting platen and first sanding platen described above with reference to the first and second aspects of the invention also apply to the third and fourth aspect of the invention.

Embodiments of the present invention will now be described, by way of example, with reference to the accompanying drawings, wherein.

Figure 1:
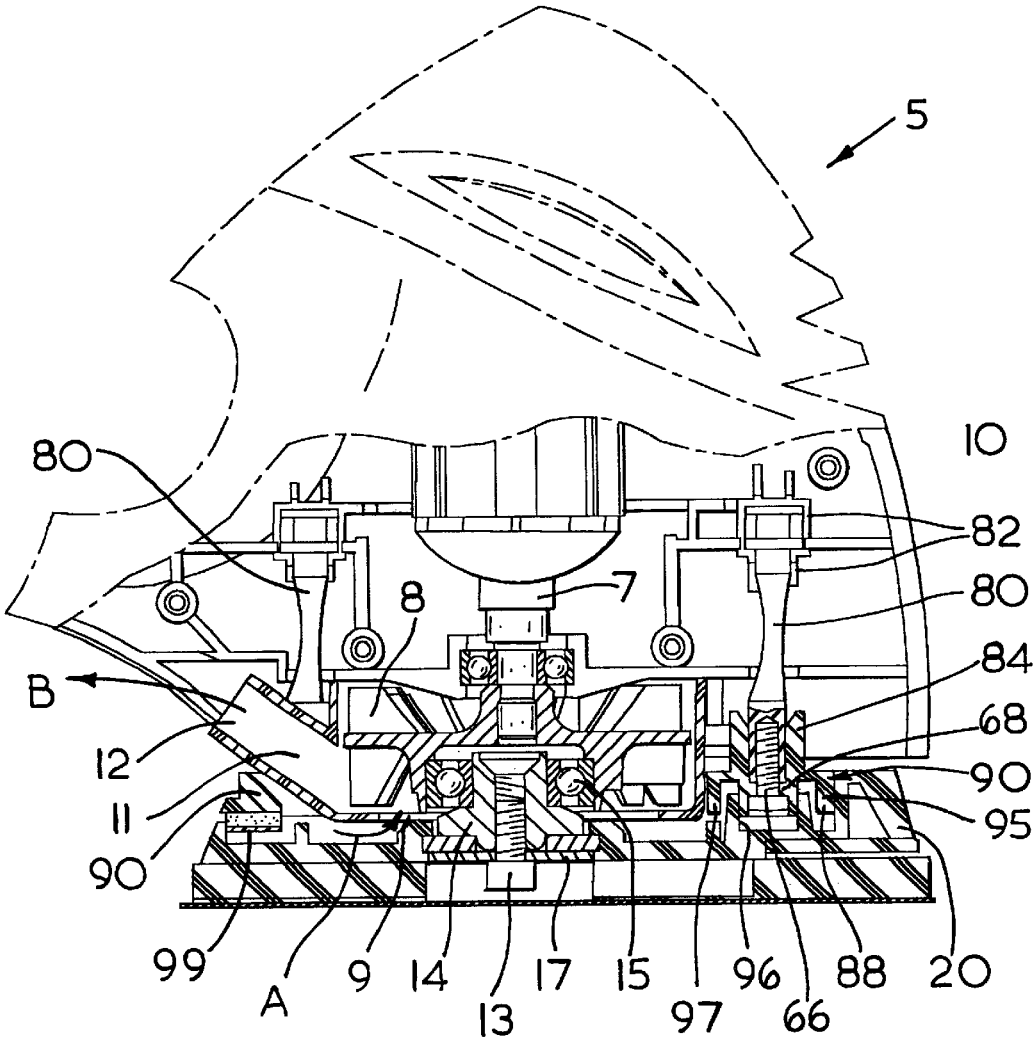
FIG. 1 is a side view, partially in section, of the hand tool according to the present invention, showing the mounting platen of the hand tool with a first sanding platen, which is an orbital sanding shoe, attached.

FIG. 1 shows a drive unit 5 including an electric motor (not shown) and first drive shaft 7. A fan 8 mounted on shaft 7 is arranged to draw air in from mouth 9 of the drive unit 5 as shown by arrow A, and direct it through extractor duct 11 to outlet 12, as shown by arrow B. Bearing 15 is eccentrically located radially with respect to shaft 7, and a second drive shaft 14 rotates about the axis of bearing 15. A mounting platen 90 is fixed to the housing 10 by means of four flexible legs 80. The mounting platen 90 is substantially flat, and the legs 80 extend from a common major surface of the platen 90 (the upper surface as shown in the Figure), directed into the body of the housing 10. The mounting platen 90 surrounds the second drive shaft 14, and is spaced radially therefrom. This means that the mounting platen 90 itself is not directly driven by the drive shaft 14.

Figure 2:
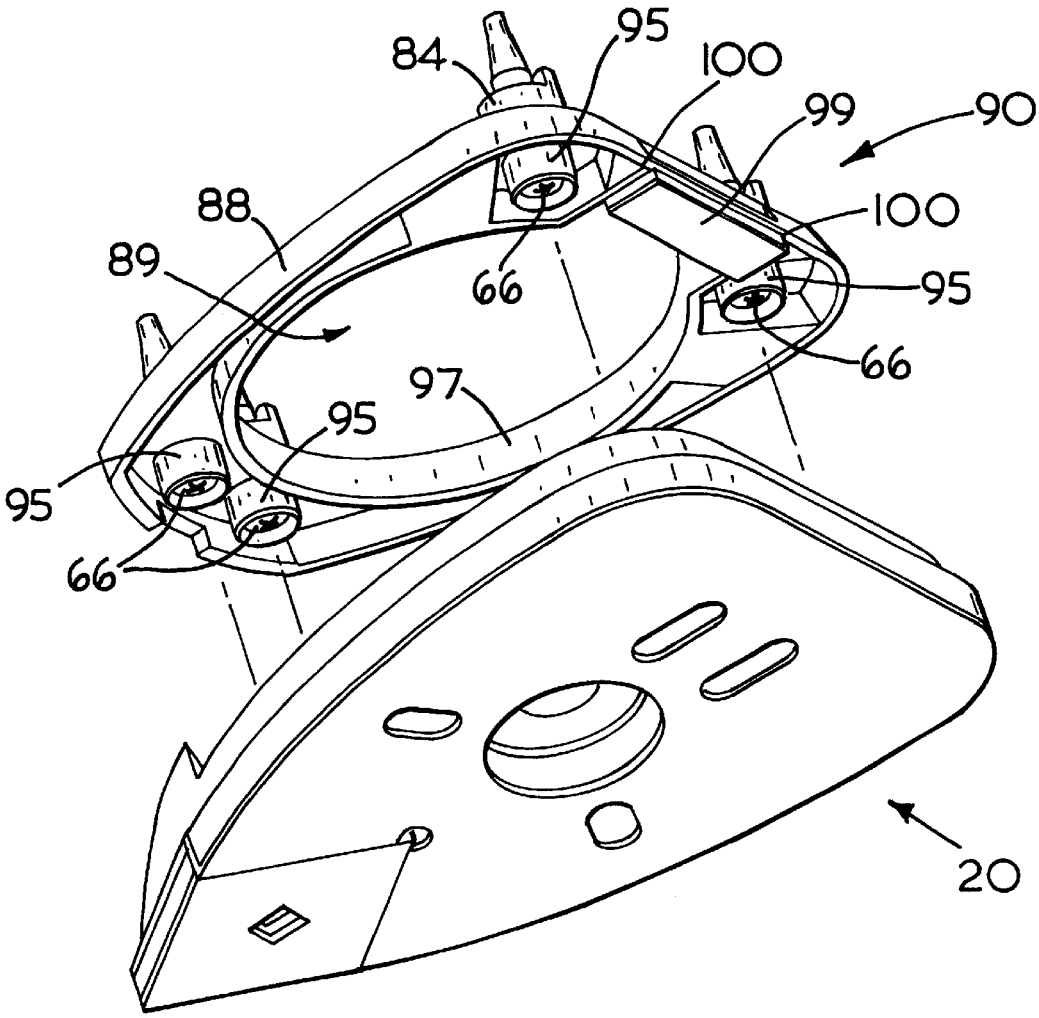
FIG. 2 is a perspective view of the mounting platen and sanding shoe of FIG. 1, showing the attachment side of the mounting platen.
Figure 3:
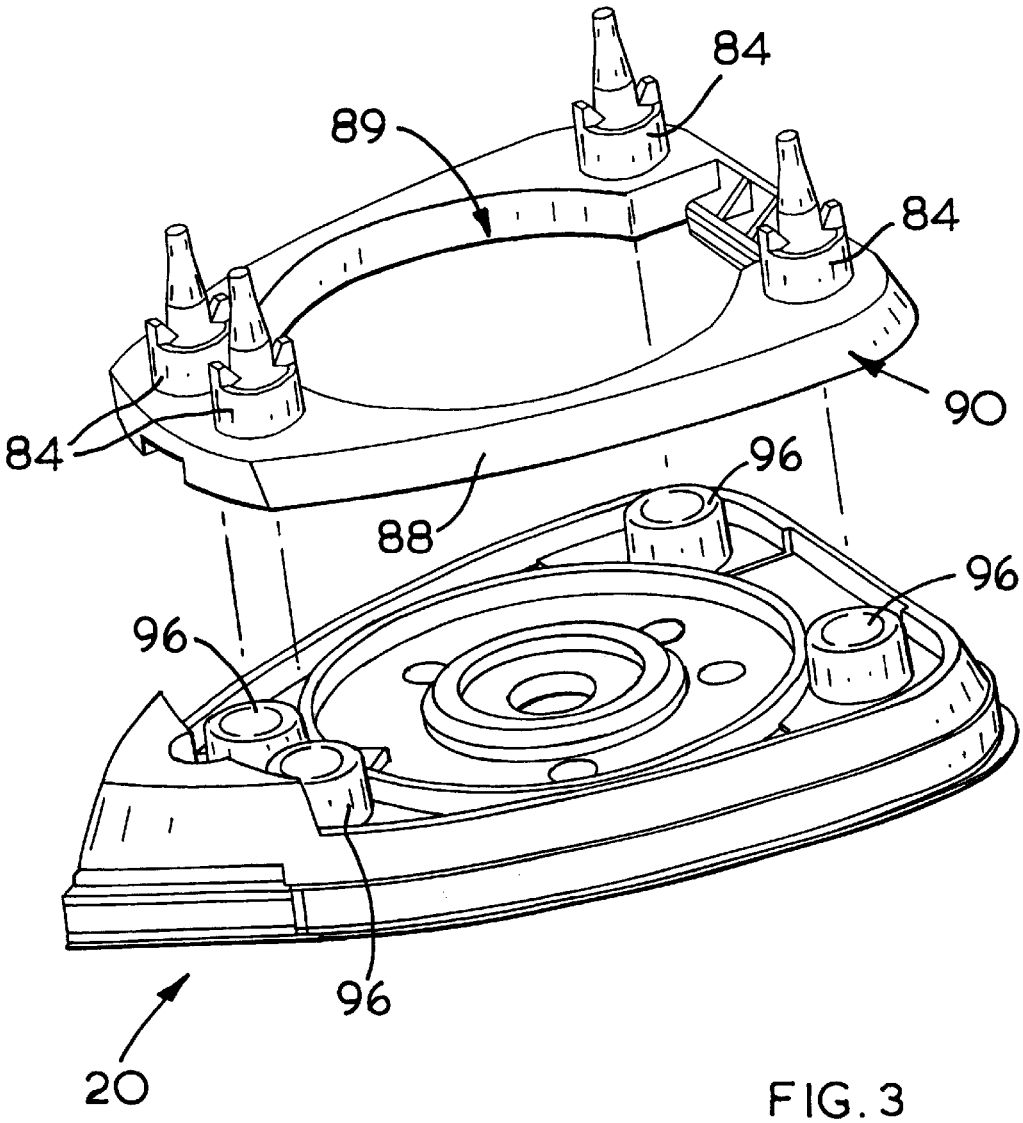
FIG. 3 is a perspective view of the mounting platen and sanding shoe of FIG. 1, showing the attachment side of the sanding shoe.

Referring now to FIGS. 2 and 3, in addition to FIG. 1, the mounting platen 90 is generally a blunt shoe shape, and is substantially flat, with a peripheral lip 88 extending downwards towards the sanding shoe 20. It contains a large central aperture 89 allowing it to be positioned around the second drive shaft, radially distant therefrom, so there is no direct contact between the mounting platen 90 and the second drive shaft 14. An inner lip 97 extends downwards around most of the aperture 89, and joins to the outer peripheral lip 96 at two points 100 on one short side of the mounting platen 90. On the surface of the mounting platen 90, facing towards the first drive shaft 7, and integrally formed with the surface of the mounting platen 90 are four hollow right cylindrical portions 84 projecting into the body of the housing 10. i.e. upwards as shown in the Figures. In line with these projections 84, and projecting in the other direction, from the opposite surface of the mounting platen 90 are four hollow, generally cylindrical pin shaped coupling members 95, also integrally formed with the mounting platen 90. The substantially flat mounting platen with its projecting portions 84 and 95 are preferably integrally injection moulded from polymeric material or diecast from zinc.

The flexible legs 80 extending from the mounting platen 90 are permanently fixed at their housing end to the housing 10, i.e. they are not removable in use by the operator. They are attached to the housing 10 by means of clamping flanges 82 of the housing 5. The flexible legs 80 are attached at their mounting platen end to the mounting platen 90 by passing through apertures in the hollow projecting portions 84 of the mounting platen 90, and securing to the inner surface of the pin-shaped coupling means 95 on the opposite major surface of the platen 90 from the flexible legs 80. To effect this securement the flexible legs 80 are each provided with an inner hollow screw threaded cylindrical recess at their mounting platen end. This is described in more detail below.

Four coupling pins 95 are provided on the opposite surface of the mounting platen 90 from the flexible legs 80, in corresponding positions, i.e. vertically aligned with the legs 80 as shown in the Figure. They are integrally formed with the mounting platen 90, preferably integrally moulded therewith, e.g. from a polymeric material or diecast zinc. The coupling means 95 have a dual function; to secure the legs 80 in place, and to couple with an orbital sanding head, in use, to prevent free rotation of that sanding head.

Each coupling pin 95 is an integrally formed part shaped as a hollow cylinder. The pin member 95 contains a radially directed flange 68 extending partially into the hollow of the pin member 95, to act as a stop member for a separate externally screw threaded headed screw member 66 (see FIGS. 1 and 2). The externally screw threaded screw member 66 passes through the hollow central pin member 95, and is shaped and sized to slide into the hollow pin member until its head abuts the internal stop flange 68, and then screw into inner hollow screw threaded cylindrical recess at the mounting platen end of the flexible legs 80. By this screw threaded bolt member 66 the flexible legs 80 are therefore secured to the mounting platen. As best seen in FIG. 2, each pin member 95 is located between part of the peripheral lip 88 and the inner lip 97 of the mounting platen 90. The pin member 95 of the coupling means 91 acts to couple to the orbital sanding shoe 20 to prevent its free rotation. This is described below.

In FIG. 1, the orbital sanding shoe 20 is shown attached to the drive unit 5. It is secured to the spindle of second drive shaft 14 by means of a bolt 13 and washer 17, the nut passing through a central aperture in the sanding shoe 20, and through the central aperture 89 of the mounting platen 90. The orbital sanding shoe 20 is substantially flat, and is provided, on its upper major surface in the orientation shown in the Figure, with coupling means 96 shaped to co-operate with the coupling means 95 of the mounting platen 90. The coupling means 96 each comprise a hollow right-cylindrical stub, projecting upwards from the surface of the sanding shoe 20. The hollow right cylindrical projection 96 is shaped so that it provides a recess into which the pin member 95 of the mounting platen fits. One side of the cylindrical projection 96 on the sanding shoe 20 fits between the peripheral lip 88 of the mounting platen 90 and the outer surface of the pin member 95 of the mounting platen 90; and the opposite side of the cylindrical projection 96 on the sanding shoe 20 fits between the inner lip 97 of the mounting platen 90 and the opposite outer surface of the pin member 5 of the mounting platen 90.

By means of the co-operating coupling means 95 and 96, the sanding shoe 20 and mounting platen 90 are therefore securely located substantially to prevent relative movement between the mounting platen 90 and the sanding shoe 20 in a plane parallel to the plane of the sanding platen 20 and the mounting platen 90. Relative movement parallel to the axis of the bearing 15 is prevented by the bolt 13 and washer 17 attachment.

In operation, when the motor is switched on and the drive shafts 7 and 14 turn, since the sanding shoe 20 is prevented from rotation relative to the mounting platen 90, and the mounting platen 90 is fixed relative to the housing 10 by means of legs 80, then free rotation of the sanding shoe 20 around the bearing 15 axis is prevented. The flexibility in the legs 80, however, allows the sanding platen 20 to follow the rotating motion of the eccentric spindle itself driven by the first drive shaft 7. Therefore the sanding shoe 20 is allowed to oscillate within a fixed orbit due to the flexibility of the legs 80.

Figure 4:
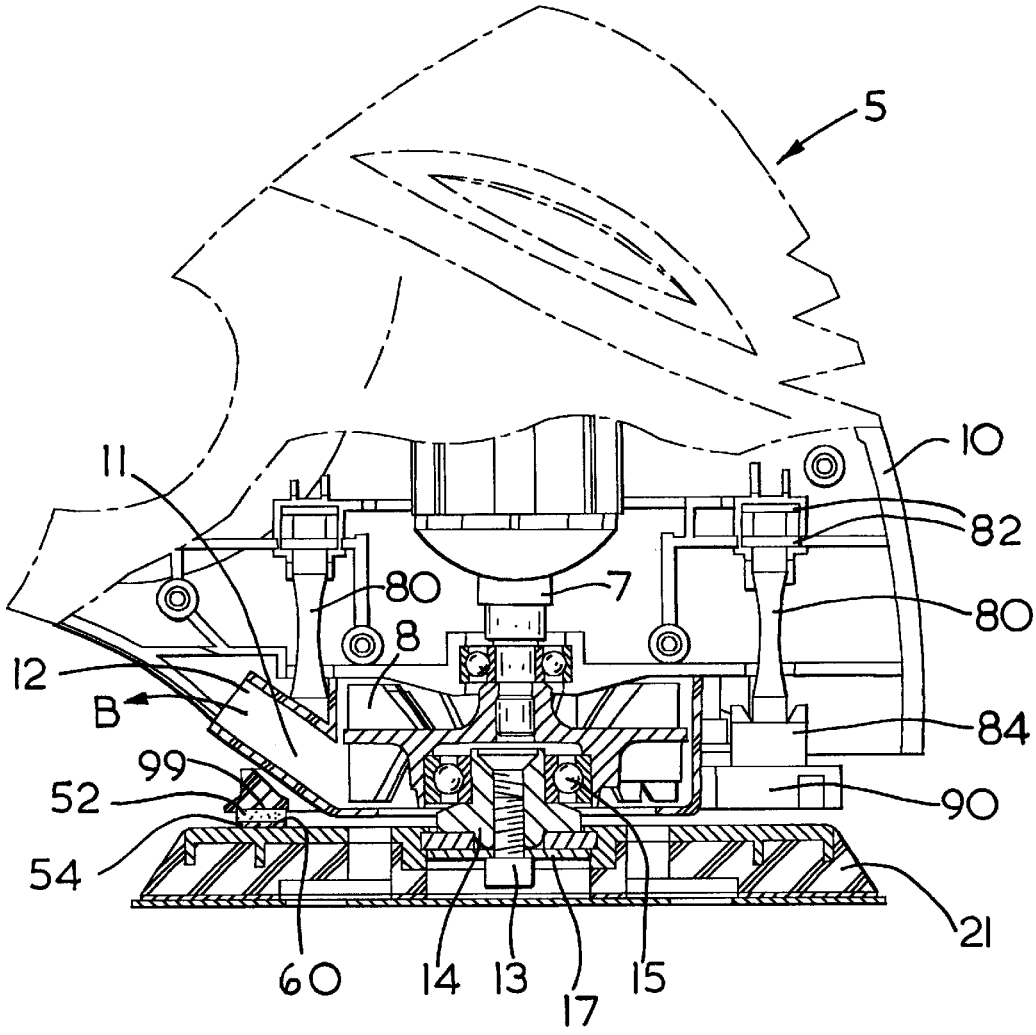
FIG. 4 is a side view, partially in section, of the hand tool of FIG. 1 showing the first sanding platen of FIG. 1 replaced by a second sanding platen which is a random orbit sanding platen.

FIGS. 3 and 4 are perspective views showing the mounting platen 90 and sanding shoe 20 and their respective four coupling means, and four flexible legs 80 extending from the mounting platen 90. These Figures clearly show the vertical alignment of the coupling means on the respective platens and with the flexible legs 80. It can also be seen from these Figures that the coupling means 95 and 96 are non uniformly spaced over the surface of the platens, those on one lateral side of the platens (the right as shown in the Figures) being further apart from each other than those on the other lateral side of the platens (the left as shown in the Figures). This arrangement ensures that the sanding shoe 20 is always located the correct way round on the mounting platen 90. FIG. 3 also illustrates a brake pad 99 positioned on the underside of the mounting pad 90. Its function is to brake a freely rotating random orbital sanding platen that can be used interchangeably with the orbital sanding shoe 20. The operation of the random orbital sanding platen and the brake 99 is described below with reference to FIG. 4.

FIG. 4 shows a random orbit sanding head 21 secured to the drive shaft 14 in place of the orbital sanding head 20. Securement of the random orbit sanding head is achieved by the bolt 13 and washer 17, as for the orbital sanding head 21. The random orbit sanding platen 21 is circular and has no upwardly projecting coupling means. When located on the second drive shaft 14 there is a clearance space between the upper surface (as shown) of the sanding platen 21 and the mounting platen 90 and pin member 95 thereon. Therefore free rotation is permitted about the bearing axis 15 and the platen 20 exhibits a random orbit. A brake 99 is provided on the under-surface of the mounting platen 90 (see FIGS. 1 and 2). The brake comprises a PTFE based abrasion resistant material mounted on a resilient member, which is compressed in operation so as to provided a braking force against the upper surface of the random orbit platen 21. The purpose of this brake is two-fold: first, in use, the brake acts as a speed limiter, operating in particular to slow the sander platen to safe limits and to prevent scratches when the unit is placed on and taken off the work surface, and secondly when the unit is switched off, the stop time is very much reduced compared to a non-braked tool.

What is claimed is:

1. A powered oscillating hand tool comprising:

a housing;

a drive unit contained in the housing and having a first drive shaft;

a bearing mounted on the first drive shaft and located radially eccentrically relative to the first drive shaft, the bearing driving a second drive shaft;

a mounting platen permanently secured to the housing by at least one flexible leg extending from a first surface of the mounting platen, the mounting platen including at least one coupling element extending from a second surface, the second surface distinct from the first surface; and a first sanding platen having at least one complimentary coupling element for coupling with the at least one coupling element of the mounting platen to provide securement against free rotation of the first sanding platen about the second drive shaft in an engaged position;

wherein the at least one coupling element includes a peripheral lip of the mounten platen.

2. The powered oscillating hand tool of claim 1 wherein the at least one coupling element further includes a plurality of coupling members extending from the second surface of the mounting platen.

3. The powered oscillating hand tool of claim 2 wherein the at least one complimentary coupling element of the sanding platen includes a plurality of complimentary projections for interfacing the plurality of coupling members in the engaged position.

4. The powered oscillating hand tool of claim 3 wherein the complimentary projections interface the plurality of coupling members concurrently with the peripheral lip of the mounting platen in the engaged position.

5. The powered oscillating hand tool of claim 4 wherein the coupling members of the mounting platen include pin members and the complimentary projections of the sanding platen include hollow cylindrical projections for receiving the pin members.

6. The powered oscillating hand tool of claim 3 wherein the plurality of coupling members and the plurality of complimentary projections are non-uniformly spaced on a respective one of the mounting platen and the sanding platen.

7. A powered oscillating hand tool comprising:

a housing;

a drive unit contained in the housing; and a mounting platen having a first side compliantly mounted to the housing and a second side having structure for providing an interference fit with a sanding platen in an orbital operating mode;

wherein the structure of the second side of the mounting platen includes a peripheral lip.

8. The powered oscillating hand tool of claim 7 wherein the structure of the second side of the mounting platen further includes a plurality of coupling elements extending therefrom.

9. The powered oscillating hand tool of claim 8 wherein the sanding platen includes a plurality of complimentary projections for interfacing the plurality of coupling members in the orbital operating mode.

10. The powered oscillating hand tool of claim 9 wherein the complimentary projections interface the plurality of coupling members concurrently with the peripheral lip of the mounting platen in the engaged position.

11. The powered oscillating hand tool of claim 10 wherein the coupling members of the mounting platen include pin members and the complimentary projections of the sanding platen include hollow cylindrical projections for receiving the pin members.

12. A powered oscillating hand tool for operating in one of an orbital mode and a random orbital mode comprising:

a housing having an eccentrically driven drive shaft;

a mounting platen permanently secured to the housing by at least one flexible leg extending from a first surface of the mounting platen, the mounting platen including at least one coupling element extending from a second surface;

a first sanding platen coupled to the drive shaft and the at least one coupling element of the mounting platen to provide securement against free rotation of the first sanding platen about the drive shaft in the orbital mode; and a second sanding platen engaged to the drive shaft and laterally offset from the mounting platen in the random orbital mode to allow free rotation of the second sanding platen about the drive shaft.

13. The powered oscillating hand tool of claim 12 wherein the at least one coupling element includes a peripheral lip of the mounting platen.

14. The powered oscillating hand tool of claim 13 wherein the at least one coupling element further includes a plurality of coupling members extending from the second surface of the mounting platen.

15. The powered oscillating hand tool of claim 14 wherein the first sanding platen includes a plurality of complimentary projections for interfacing the plurality of coupling members in the orbital mode.

16. The powered oscillating hand tool of claim 15 wherein the complimentary projections interface the plurality of coupling members concurrently with the peripheral lip of the mounting platen in the engaged position.

17. The powered oscillating hand tool of claim 16 wherein the coupling members of the mounting platen include pin members and the complimentary projections of the sanding platen include hollow cylindrical projections for receiving the pin members.

18. A powered oscillating hand tool for operating in one of an orbital mode and a random orbital mode comprising:

a housing;

a drive unit contained in the housing and having a first drive shaft;

a bearing mounted on the first drive shaft and located radially eccentrically relative to the first drive shaft, the bearing driving a second drive shaft;

a mounting platen permanently secured to the housing by a first and second pair of longitudinal flexible elements each defining a first mounting axis and extending from a first surface of the mounting platen, the mounting platen including a first and second pair of cylindrical coupling elements extending from a second surface of the mounting platen, the first pair of cylindrical coupling elements extending from a forward end of the mounting platen and spaced differently then the second pair of cylindrical coupling elements extending from a rearward end of the mounting platen, the cylindrical coupling elements each defining a second mounting axis, each of the respective second mounting axes coaxial with each of the respective first mounting axes, the mounting platen including a peripheral lip laterally offset from the cylindrical coupling elements;

a first sanding platen for operation in the orbital mode, the first sanding platen coupled to the drive shaft and having a first and second pair of hollow cylindrical projections each defining a third mounting axis, each of the respective third mounting axes coaxial with each of the first and second mounting axes, the first and second pair of hollow cylindrical projections each having an inner dimension for receiving the first and second pair of cylindrical coupling elements of the mounting platen therein, the first and second pair of hollow cylindrical projections each having an outer dimension for interfacing the peripheral lip of the mounting platen, the first sanding platen secured to the mounting platen to inhibit free rotation of the first sanding platen about the drive shaft in the orbital mode; and a second sanding platen for operation in the random orbital mode, the second sanding platen engaged to the drive shaft and laterally offset from the mounting platen in the random orbital mode to allow free rotation of the second sanding platen about the drive shaft.

* * * * *